US005103785A

United States Patent [19]

Henkel

[11] Patent Number: 5,103,785

[45] Date of Patent: Apr. 14, 1992

[54] FUEL INJECTION DEVICE FOR AIR COMPRESSING COMBUSTION ENGINES

[75] Inventor: Dietmar Henkel, Neumarkt, Fed. Rep. of Germany

[73] Assignee: MAN Nutzfahrzeuge AG, Münich, Fed. Rep. of Germany

[21] Appl. No.: 729,393

[22] Filed: Jul. 12, 1991

[30] Foreign Application Priority Data

Jul. 12, 1990 [DE] Fed. Rep. of Germany ..... 4022226

[51] Int. Cl.[5] ..... F02B 3/00

[52] U.S. Cl. ..... 123/299; 123/300; 239/5

[58] Field of Search ..... 123/299, 300, 501, 467, 123/446; 239/5

[56] References Cited

U.S. PATENT DOCUMENTS

| | | | |
|---|---|---|---|
| 4,173,208 | 11/1979 | Ferbc et al. | 123/299 |
| 4,426,198 | 1/1984 | Bastanhof et al. | 123/299 |
| 4,700,672 | 10/1987 | Baguena | 123/299 |
| 4,711,209 | 12/1987 | Henkel | 123/300 |
| 4,811,899 | 3/1989 | Eglar | 239/5 |

*Primary Examiner*—Raymond A. Nelli
*Attorney, Agent, or Firm*—Robert W. Becker & Associates

[57] ABSTRACT

A fuel injection device for air compressing combustion engines is provided. In order to reduce undesirable combustion noises it is suggested to divide the injection step into a pre-injection and a main injection. For this purpose, a pressure wave generator is introduced into the injection line which ensures that, even under partial load and at low revolutions of the combustion engine, due to the sudden opening of the pressure wave generator, a high pressure level for the pre-injection is provided. The opening pressure of the pressure wave generator is controlled by the play of forces between the effective hydraulic piston surface and a closing spring, respectively, a piston, whereby the piston may be actuatable via a performance range controlled auxiliary pressure source. Due to the high pressure level provided the pre-injection portion is finally atemized. Subsequent to the pre-injection the main injection commences with a delay resulting from the travel time difference between the two injection lines.

4 Claims, 2 Drawing Sheets

FUEL INJECTION DEVICE FOR AIR COMPRESSING COMBUSTION ENGINES

The present invention relates to a fuel injection device for air compressing combustion engines, whereby the fuel injection device comprises an injection pump, an injection valve and injection lines that are connecting the injection pump with the injection valve, with a first one of the injection lines directly connecting the injection pump for achieving a pre-injection and with a second one of the injection lines of a greater length serving to timely induce a main injection. The difference in length between the first and the second injection lines is selected such that a travel time difference of a pressure wave starting at the injection pump corresponds to a time difference between the pre-injection and the main injection.

Dividing the amount of fuel to be injected into a pre-injection portion and a main injection portion is known from U.S. Pat. No. 4,711,209. Here, two injection lines of respective different lengths are provided that are connected to a serial injection pump. A first injection line leads directly to a dosage valve unit with a cylinder and a piston, while a second injection line branches off directly before the dosage valve unit and opens via a check valve into a line which comes from the dosage valve unit and extends into the injection valve. Due to the longer injection line, at the beginning of the fuel injection step, the piston of the dosage valve unit is moved and an amount of fuel that corresponds to the cylinder volume is pre-injected. Due to the extension of the first injection line by a length of a second line which is connected to the first one in a serial connection, the main injection occurs with a delay that corresponds to the travel time necessary for passing the second line. In order to avoid adverse effects that might cause a pressure reduction during the pre-injection, the second line is provided with a check valve.

The prior art device is disadvantageous because, at low revolutions per minute, the fuel pressure at the beginning of the pre-injection is too low to achieve a good fuel/air mixture due to the reduced replacement speed of the piston of the dosage valve unit.

In order to reduce the combustion noises of directly injecting diesel engines, the so-called pre-injection is employed. The realization of such a pre-injection is often difficult, when the amount of fuel to be injected via the injection valve is determined by the displacement piston principle.

This holds true for the commonly employed serial and distributor injection pumps which, in general, work according to the aforementioned principle. For example, it has been suggested, to atomize the relatively small pre-injection portion of fuel with the same valve through which also the main injection portion is introduced, but in doing so the following problems must be overcome.

It is desired to achieve a better fuel/air mixture and for this purpose multi-hole valves are employed more often, whereby the hole diameter is adjusted to the relatively short injection times which corresponds to a relatively large total cross-section in order to accommodate the high volume stream under full load. In order to achieve an acceptable atomization with the same valve for the relatively small pre-injection portions a short impulse having a high fuel pressure is therefore necessary. Due to the dependency of the displacement velocity of the injection pump plunger from the momentary revolutions of the engine, it is obvious that, even when a large pre-stroke is selected, at low or medium revolutions of the engine the timely course of the fuel volume stream will ensure the sufficient atomization of the pre-injection amount in only a few cases.

It is therefore an object of the present invention to provide a fuel injection device of the aforementioned kind whereby, independent of the load and revolution state of the combustion engine, a constant amount of fuel during the pre-injection phase in a working cycle is ensured by reproducibly forcing a time-controlled pressure course at the inlet of the injection valve.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
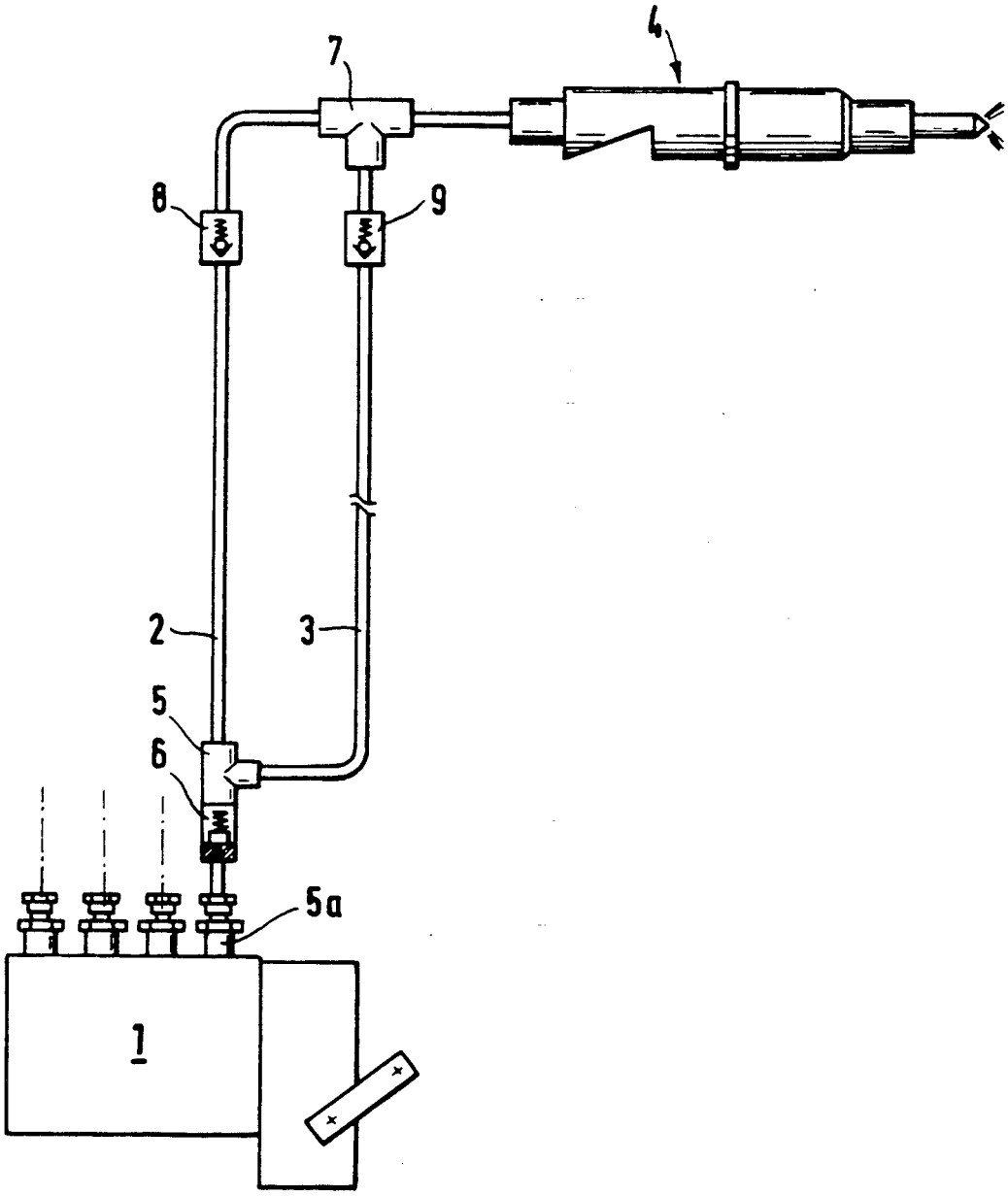
FIG. 1 shows a circuit diagram for the arrangement of an injection pump and an injection valve with the respective connecting injection lines.

The fuel injection device of the present invention is primarily characterized by a pressure wave generator which is disposed between an outlet of the injection pump and a first distributer of the first and second injection lines; a second distributor reconnecting the first and the second injection lines; a first check valve being disposed before the second distributor within the first injection line and a second check valve is disposed before the second distributor within the second injection line, whereby the first and the second check valves prevent return flow from the second distributor towards the pressure wave generator; and respective sections of the first and the second injection lines between the check valves and the second distributor and a third injection line between the second distributor and the injection valve being as short as constructively possible.

In a preferred embodiment, the pressure wave generator is essentially in the form of an injection valve, having a valve holder, a valve body with a pressure chamber, and a control member, whereby fuel is introduced into the pressure chamber via an inlet bore for actuating the control member; the control member comprises a valve shaft for opening and closing an outlet bore in a direction toward the first distribution of the first and second injection lines. The valve shaft comprises a cylindrical portion of a first diameter and a truncated cone portion, with the truncation facing the outlet valve and having a second diameter. The difference between a first surface area corresponding to the first diameter and a second surface area corresponding to the second diameter is sufficient to open the control member at a predetermined opening force.

By employing the pressure wave generator the path of the fuel from the injection pump to the injection lines is opened only when a predetermined high pressure level has been achieved which, in the form of a pressure wave, is running towards the injection valve and is reflected there, thus resulting in a doubling of the static pressure before the valve needle of the injection valve. Due to this high pressure the valve needle opens and, as desired, an injection jet with finely atomized droplets is generated. Due to the different lengths of the injection lines a reproducible division of the portions to be injected into a pre-injection and a main injection is achieved. The selection of the difference in length between the two injection lines may be determined, under consideration of the pressure waves traveling at the speed of sound, allows for the determination of the time difference between the beginning of the pre-injection and the main injection, as desired.

Due to the sudden opening of the control member as a consequence of the pressure surface that is available to the fuel pressure after opening of the control member, the potential energy that has been stored within the pressure chamber is released and results in a great downstream pressure wave which is doubled, as mentioned before, due to the reflection at the sealing seat of the valve needle of the injection valve. Thus, the valve needle opens for the pre-injection and closes immediately upon the pressure reduction. Due to subsequent feeding of fuel from the injection pump the pressure within the pressure chamber of the pressure wave generator does not decrease below a predetermined closing pressure so that after the delayed arrival of the pressure wave from the second injection line at the valve holder the control member is still in its open position and due to the renewed opening of the valve needle by reflection of the pressure wave the main injection is started.

In a preferred embodiment the control member comprises a piston for preloading the valve shaft, whereby the control member opens against the force of the piston. The piston is connected via a bore to an auxiliary pressure source so that the piston is loadable by a hydraulic pressure that is performance range controlled. In another embodiment the control member is preloaded by a pre-stressed spring, whereby the control member opens against the force of the spring.

The second embodiment is less cost extensive and is practical when the requirements for the regulation of the injection are not as demanding.

DESCRIPTION OF PREFERRED EMBODIMENTS

The present invention will now be described in detail with the aid of several specific embodiments utilizing FIGS. 1 through 3.

A hydraulic circuit diagram of a fuel injection device is represented in FIG. 1. A fuel injection pump 1 is connected via a first and second injection lines 2 and 3 to an injection valve 4. After the outlet 5a of the injection pump 1 the second injection line 3 branches off via a first distributor 5 from the first injection line 2. According to the present invention, between the outlet 5a of the injection pump 1 and the first distributor 5, a pressure wave generator 6 is disposed which will be described in detail in subsequent paragraphs. The two injection lines 2 and 3 are reconnected before the injection valve 4 via a second distributor 7. The first injection line 2 serves to transport a pre-injection portion of the fuel while the second injection line serves to transport the main injection portion of the fuel. For this purpose, the second injection line 3 is extended by an amount L longer than the first injection line 2. This difference in length equates to $$\Delta L = C \cdot \Delta T$$

whereby

C = the speed of sound in the fuel.

ΔT = the time difference between the beginning of the pre-injection and the beginning of the main injection.

The check valves 8 and 9 are disposed before the second distributor 7 whereby a first check valve 8 is connected within the first injection line 2 and a second check valve 9 is connected within a second injection line 3. The check valves 8 and 9 allow fuel to pass in the direction from the injection pump 1 to the injection valve 4 while they are closed off in the counter direction. The check valves 8 and 9 as well as the injection valve 4 should be placed as close as possible, under the given constructive limitation, to the distributor 7.

Figure 2:
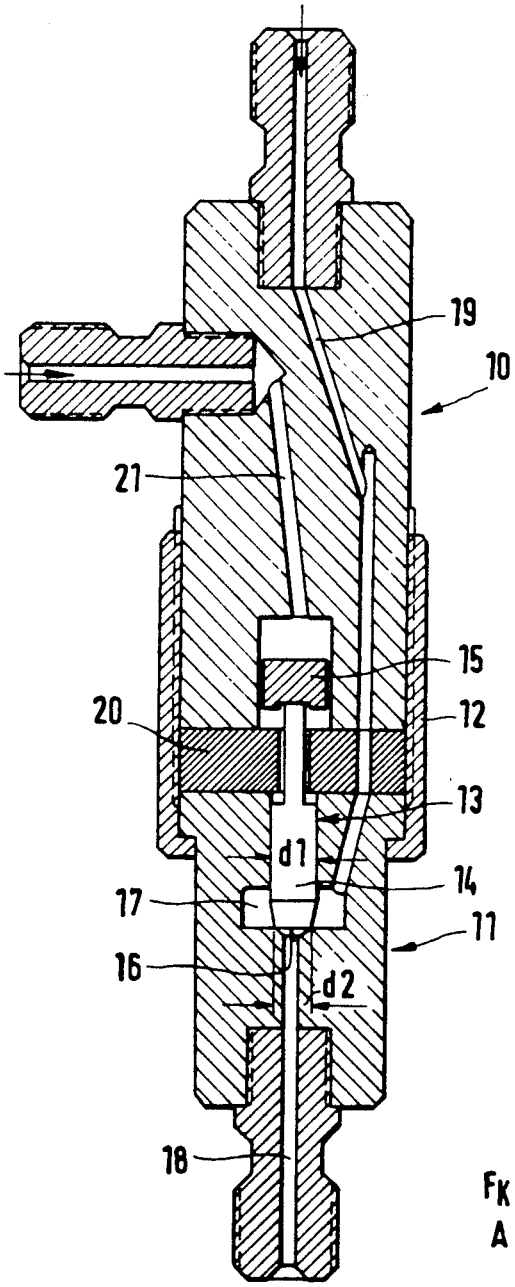
FIG. 2 shows a longitudinal cross section of a pressure wave generator.

A constructive embodiment of the pressure wave generator 6 is represented in FIG. 2. The construction of the pressure wave generator 6 resembles a common injection valve. It comprises a valve holder 10, a valve body 11 and a screw cap 12 which connects both parts 10 and 11. A control member 13 is axially movably guided within the valve body 11, whereby the control member comprises a valve shaft 14 and a piston 15. The piston 15 is loosely connected to the valve shaft 14. The valve shaft 14 has a diameter d1 and is provided with a truncated cone portion at its tip which has a planar sealing surface 16 of a diameter d2. The sealing surface 16 seals a pressure chamber 17 against an outlet bore 18 which connects to the first distributor 5 (FIG. 1). The pressure chamber 17 coaxially surrounds the valve shaft 14 whereby the pressure chamber 17 is connected via an inlet bore 19 to the outlet 5a of the injection pump. In order to limit the axial displacement of the control member 13 an abutment is provided at a coupling plate 20 which is clamped between the valve holder 10 and the valve body 11.

In order to provide a flexible control of the control member 13 it is advantageous that the piston 15 is connected via a bore 21 to a performance range controlled auxiliary pressure source which is not represented in the drawings. As a simpler but nonetheless demanding solution of the closing force generation at the valve shaft 14 a respectively dimensioned pre-stressed pressure spring may be employed instead of the auxiliary pressure controlled piston 15. The prestressed force of the pressure spring then corresponds to the range of the force $F_K$ of the piston 15 (FIG. 3).

In the following paragraphs the operation of the pressure wave generator 6 will be explained in detail with the aid of the diagram represented in FIG. 3.

Figure 3:
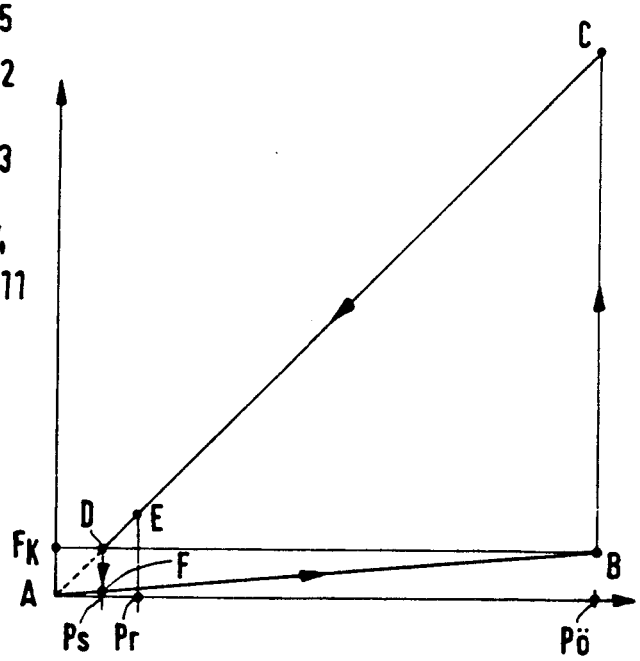
FIG. 3 is a representation of the force onto a control member of the pressure wave generator as a function of the pressure at the control member.

In the diagram of FIG. 3 the abscissa represents the pressure within the pressure chamber 17 of the pressure wave generator 6 according to FIG. 1 while the ordinate represents the forces acting on the valve shaft 14. The force $F_K$ of the piston 15, which due to its effect should be provided with a minus sign, respectively, the force resulting from the pressure spring, is shown as a straight line $F_K$-B parallel to the abscissa.

With the beginning fuel injection of the injection pump the pressure build up within the pressure chamber 17 of the pressure wave generator is started (FIG. 2). The pressure acts on the effective hydraulic cross-section of the valve shaft 14 which corresponds to the surface area difference between the surfaces area corresponding to d1 respectively d2. The pressure generates a force at the valve shaft 14 which is represented in the diagram by the line A-B. When the pressure increases further the force finally corresponds to the piston force $F_K$ so that the closing force and the oppositely directed hydraulic opening force resulting from the opening pressure po are equal to one another. The slight increase over the opening pressure (due to the continuing fuel injection) results in the opening of the valve sealing seat. At the same time the effective pressure surface increases to the value of the surface area corresponding to the diameter d1 resulting in a sudden increase of the hydraulic force acting on the valve shaft 14 and corresponding to the line B-C represented in FIG. 3. The comparatively high amount of this force explains the high opening speed of the valve. The immediately resulting pressure collapse within the pressure chamber 17 results in the decrease of the hydraulic force at the valve shaft 14 corresponding to the line connecting C to E. The point E in the diagram of FIG. 3 corresponds to the pressure value pr. Under these conditions, the valve shaft 14 rests constantly at the abutment of the opening position. Since fuel is further injected by the injection pump the pressure will increase to a value that is smaller than the opening pressure po but greater than the pressure pr while the valve cross-section remains open.

When the fuel injection step of the injection pump 1 is ended and therefore the pressure of the fuel within the pressure chamber 17 is reduced (FIG. 2), the hydraulic force at the valve shaft 14 is correspondingly reduced, as is shown by the line C-A in the diagram of FIG. 3, in the direction towards the point A. When the pressure level reaches the closing pressure ps of the pressure wave generator 6, the closing force $F_K$ of the piston 15 and the hydraulic opening force equal one another. This situation is represented in the diagram at the interception of the lines C-A and $F_K$-B. When the fuel pressure is slightly lower than the closing pressure ps the force of the piston 15 is greater and the valve is forced into its closing position. The change of the hydraulic force corresponds to the line D-F in the diagram of FIG. 3.

Guidelines for the desired valve specific ratio Vpo of the closing pressure relative to the opening pressure is given by the equation $Vpo = Vd^2_2$ whereby $Vd^2_2$ corresponds to the square of the diameter ratio of d2 to d1.

In order to explain the operating mode of the second injection line 3 the time-depending course of the valve opening within the pressure wave generator 6 shall be recalled again. The course of the valve opening was accompanied by the generation of a pressure wave which was running downstream via the outlet bore 18 of the pressure wave generator 6 (FIG. 2). On its further path the pressure wave then reaches the first distributor 5. Here, a symmetrical division of the pressure wave energy is achieved since the pressure wave enters identical cross sections of the injection lines 2, 3 which are in parallel to one another. The second injection line 3 (delay line) is extended by such an amount that the impulse travel time compared to the first injection line 2 is greater by the amount ΔT. The travel time depends on the speed of sound of the fuel. ΔT represents a time which corresponds to or is slightly greater than the firing delay time of the desired pre-injection portion. Two pressure waves are running downstream within the injection lines 2 and 3 at the speed of sound, whereby the pressure wave within the injection line 2 reaches the respective spring-loaded check valve 8 first. After opening the check valve 8 the pressure wave continues on via a connecting line, the second distributor 7 and a further connecting line (both very short), and subsequently reaches the valve holder of the injection valve 4 (FIG. 1). An undesirable return of the pressure wave energy into the second injection line 3 is prevented by the second check valve 9. Due to the reflection of the pressure wave at the closed sealing seat of the injection valve 4 a superposition of the reflected portion of the pressure wave, as commonly known, with the pressure wave component that is still running towards the valve seat, results in a doubling of the pressure at the reflection location. The very high resulting pressure results in a fast opening of the valve slit accompanied by the injection of the pre-injection portion, and causes an especially good atemization of the fuel. Immediately, the valve needle falls back into its position, thereby closing the valve slit, while at the same time the pressure wave coming from the second injection line 3 reaches the check valve 9 and travels via the distributor 7 into the valve holder of the injection valve 4. The second pressure wave reaches the injection valve 4 delayed by a time ΔT which corresponds to the firing delay time of the injection amount. A reduction of the pressure wave energy due to return flow into the first injection line 2 is prevented by the check valve 8. In this case, the aforementioned effect of the pressure doubling due to the pressure wave superposition also results in an excellent atemization of the fuel during the commencing initial phase of the main injection. An undesirable closing of the valve needle immediately after the beginning of the main injection, similar to the events during the pre-injection, must not be feared since in the meantime, first via the first injection line 2, then delayed via the second injection line 3, more fuel for maintaining the main injection will be provided. The further course of the main injection corresponds to the conventionally known operation of injection devices that are provided with only a single injection line. However, it is important to consider the standing pressure present in the two injection lines 2 and 3 which is determined by the closing pressure of the pressure wave generator 6. When designing the pressure controlled pressure wave generator 6 it must be taken into consideration when determining the respective closing pressure that it must be clearly below a value of the closing pressure pr. Pr is the remaining minimal pressure within the pressure chamber 17 immediately after the generation of pressure waves for the purpose of the pre-injection (FIGS. 1 and 2). The closing pressure of the pressure wave generator, at the same time, must be equal to the amount of the desired standing pressure within the injection lines. From this it is clear that the closing pressure of the injection valve must be higher than the one of the pressure wave generator.

With respect to the fuel-guiding cross-sections of the connecting lines of the injection pump 1 to the pressure wave generator 6, respectively, of the second distributor 7 to the injection valve 4 (FIG. 1), and as well from the fuel-guiding channels within the pressure wave generator 6 and the distributor 5, 7 it should be noted that they must be at least dimensioned such that their sum corresponds at least to the sum of the two fuel-guiding cross-sections of the injection lines 2 and 3. It has been mentioned before that the cross-sections of the injection lines 2 and 3 must be equal, however, this does not preclude t hat their ratio, provided that the sum of the cross-sections remains the same, under certain circumstances may be changed in favor of a greater cross section of the second injection line 3. This is preferable when the pre-injected portion is too great. A reduction of the pre-injected portion is then simply achieved by a reduction of the diameter of the first injection line 2 which must be accompanied by a corresponding diameter enlargement of the second injection line 3 so that the aforementioned constant sum of the cross sections of the injection lines 2 and 3 is maintained.

The present invention is, of course, in no way restricted to the specific disclosure of the specification and drawings, but also encompasses any modifications within the scope of the appended claims.

What I claim is:

1. In a fuel injection device for air compressing combustion engines, said fuel injection device comprising an injection pump, an injection valve and injection lines that are connecting said injection pump with said injection valve, with a first one of said injection lines directly connecting said injection pump for achieving a pre-injection and with a second one of said injection lines having a greater length serving to timely induce a main injection, whereby a difference in length between said first and said second injection lines is selected such that a travel time difference of a pressure wave starting at said injection pump corresponds to a time difference between said pre-injection and said main injection, the improvement wherein:

a pressure wave generator is disposed between an outlet of said injection pump and a first distributor of said first and second injection lines;

a second distributor reconnects said first and said second injection lines;

a first check valve is disposed before said second distributor within said first injection line and a second check valve is disposed before said second distributor within said second injection line, whereby said first and said second check valves prevent return flow from said second distributor towards said pressure wave generator; and respective sections of said first and said second injection lines between said check valves and said second distributor, and of a third injection line between said second distributor and said injection valve are as short as constructively possible.

2. A fuel injection device according to claim 1, wherein said pressure wave generator is essentially in the form of an injection valve, having a valve holder, a valve body with a pressure chamber, and a control member, whereby fuel is introduced into said pressure chamber via an inlet bore for actuating said control member; and with said control member comprising a valve shaft for opening and closing an outlet bore in a direction toward said first distributor of said first and second injection lines, said valve shaft comprising a cylindrical portion of a first diameter and a truncated cone portion, with the truncation facing said outlet valve and having a second diameter, whereby a difference between a first surface area corresponding to said first diameter and a second surface area corresponding to said second diameter is sufficient to open said control member at a predetermined opening force.

3. A fuel injection device according to claim 2, wherein said control member further comprises a piston for preloading said valve shaft, whereby said control member opens against a force of said piston, said piston being connected via a bore to an auxiliary pressure source so that said piston is loadable by a hydraulic pressure that is performance range controlled.

4. A fuel injection device according to claim 1, wherein said control member is preloaded by a prestressed spring, whereby said control member opens against a force of said spring.

* * * * *